US009187101B2

(12) United States Patent
Gubler

(10) Patent No.: US 9,187,101 B2
(45) Date of Patent: Nov. 17, 2015

(54) CABIN FOR ACCOMMODATING PASSENGERS AND/OR GOODS

(71) Applicant: CWA CONSTRUCTIONS S.A., Olten (CH)

(72) Inventor: Daniel Gubler, Brittnau (CH)

(73) Assignee: CWA CONSTRUCTIONS SA, Olten (CH)

( * ) Notice: Subject to any disclaimer, the term of this patent is extended or adjusted under 35 U.S.C. 154(b) by 156 days.

(21) Appl. No.: 13/904,852

(22) Filed: May 29, 2013

(65) Prior Publication Data

US 2013/0333589 A1 Dec. 19, 2013

Related U.S. Application Data

(63) Continuation of application No. 13/060,938, filed as application No. PCT/EP2009/060803 on Aug. 20, 2009, now abandoned.

(30) Foreign Application Priority Data

Aug. 29, 2008 (CH) ..... 1383/08

(51) Int. Cl.
*B61B 12/00* (2006.01)

(52) U.S. Cl.
CPC ..... *B61B 12/002* (2013.01)

(58) Field of Classification Search
CPC ..... B61B 12/002; B60J 10/02; B60J 1/10
USPC ..... 105/149.1; 296/201
See application file for complete search history.

(56) References Cited

U.S. PATENT DOCUMENTS

| | | | | |
|---|---|---|---|---|
| 4,635,561 | A | 1/1987 | Tauzin | |
| 4,703,973 | A | 11/1987 | Fujikawa | |
| 4,847,977 | A | 7/1989 | Gold | |
| 7,082,880 | B2 | 8/2006 | Schertler | |
| 2006/0005476 | A1 | 1/2006 | Riser | |
| 2011/0155017 | A1 * | 6/2011 | Gubler | 105/149.1 |

FOREIGN PATENT DOCUMENTS

| | | |
|---|---|---|
| CH | 306 828 | 4/1955 |
| DE | 23 36 375 | 2/1974 |
| DE | 299 02 418 | 8/1999 |

(Continued)

OTHER PUBLICATIONS

International Search Report issued Mar. 29, 2010 in PCT/EP09/60803 filed Aug. 20, 2009.

*Primary Examiner* — Zachary Kuhfuss
(74) *Attorney, Agent, or Firm* — Oblon, McClelland, Maier & Neustadt, L.L.P.

(57) ABSTRACT

A cabin for accommodating at least one of passengers and goods, including an opening and a holder fastened to the cabin for holding a glazing unit in the opening. The cabin includes at least two connection members that each include a first fastening part connected to the glazing unit and a second fastening part connected to the cabin. The glazing unit is secured in the region of the opening when the glazing unit has detached from the holder. The glazing unit can, for example, be pressed out of the holder as a result of persons carried in the cabin violently pushing or striking the inner side of the glazing unit. However, the connection member prevents these persons from falling downwards out of the cabin. The glazing unit is also prevented from falling. As a result, safety of the passengers and/or goods in the cabin is ensured.

17 Claims, 10 Drawing Sheets

(56) References Cited

FOREIGN PATENT DOCUMENTS

| | | |
|---|---|---|
| EP | 0 148 059 | 7/1985 |
| EP | 1 619 099 | 1/2006 |
| FR | 2 343 635 | 10/1977 |
| FR | 2 655 934 | 6/1991 |
| FR | 2 838 696 | 10/2003 |

* cited by examiner

CABIN FOR ACCOMMODATING PASSENGERS AND/OR GOODS

CROSS REFERENCE TO RELATED APPLICATIONS

This application is a continuation of U.S. patent application Ser. No. 13/060,938 filed on Feb. 25, 2011, which is a U.S. National Stage application of PCT/EP09/060803 filed on Aug. 20, 2009, and claims the benefit of priority to Swiss patent application no. 01383/08 filed on Aug. 29, 2008, and these applications are herein incorporated by reference.

The invention relates to a cabin for accommodating passengers and or goods according to the preamble of the independent patent claim 1.

From the prior art, boxes or cabins for cable cars, in particular cable railways are known, the supporting elements of which consist of a bottom frame, a roof frame and at least four corner pillars which connect the bottom frame to the roof frame. Such a cabin is described, for example, in EP 1619099 A1. At the supporting elements, two opposing side walls, wherein at least one of which has a door opening, two opposing front walls, one bottom and one roof are arranged. In particular the front walls and the side wall opposing the door opening are equipped with large windowpanes.

In the known cable cars, the windowpanes of the cabins are inserted in grooves which are provided along a window frame of the cabin. In addition, between window frame and windowpane, a rubber strip is inserted in the grooves for securing or clamping the windowpane. The glazing unit can also be glued into the grooves.

For the known cable cars, this structure has indeed proven to be useful under normal operating conditions. However, under particular circumstances it was found that it is a disadvantage that the windowpanes have been detached from the window frame so that persons or goods have been harmed. If a running cabin is stopped within a few milliseconds, for example, by an obstacle or a cable derailment, the unsecured persons or goods within the cabin are pressed against the inner side of a windowpane. The occurring forces can be high enough to push the windowpane out of the clamp in the window frame. A major disadvantage is that, for example, persons can fall out of the cabin and can be harmed. Another disadvantage is that the detached windowpane can fall downwards and can put persons and animals standing underneath the cabin seriously at risk. Even during a standstill of the cabin, the glazing unit can be pushed out of the window frame or the holder, for example, by influence of high forces.

The present invention is therefore based on the object to eliminate the disadvantages of the prior art. In particular, persons and goods are to be protected from falling out of the cabin.

Said objects are solved according to the invention by a cabin with the features of the claim 1. Advantageous developments of the cabin according to the invention arise from the dependent claims.

The important feature of the present invention is a cabin for accommodating passengers and/or goods, with an opening and with a holder fastened to the cabin for holding a glazing unit in the opening, wherein the cabin comprises at least two connection members which each comprise a first fastening element connected to the glazing unit and a second fastening element connected to the cabin, wherein the glazing unit is secured by means of the connection members in the region of the opening if the glazing unit detaches itself from the holder. One of the advantages of the invention is that the connection member connects the glazing unit to the cabin even if the glazing unit snaps out of the holder which can occur in the event of a hard impact against the inner side of the glazing unit caused by a passenger. Thus, it can be prevented that persons or passengers or goods can fall out of the cabin. Thereby, the device according to the invention ensures the safety of the passengers. Another advantage is that, similar to a cable fixed at two points, the combination of glazing unit and connection members additionally holds the cabin together. It was found to be advantageous that in each case the first and the second fastening elements of a connection member is arranged in such a manner that the extension of an imaginary connecting line between the two fastening elements cuts approximately through the center of the glazing unit. Preferably, the connection members are equally spaced apart from each other.

In one embodiment variant, the first fastening element and the second fastening element of a connection member of the cabin are connected to each other by means of a bendable and/or flexible connection element. One of the advantages of the invention is that the expansion of the materials of the cabin, in particular of the glazing unit and the holder, caused by temperature fluctuations can be compensated at the connection members. Thus, material stresses can be compensated via the bendable and/or flexible connection element. A further advantage over a rigid connection element is that due to its elastic and deformable properties, the connection element can withstand different kinds of loads caused, for example, by pressure, tension and torsion. Flexible means here to be able to adapt to changing conditions, to be ready to react, or to be bendable, elastic or resilient. This flexibility is also necessary because the direction of the load, for example the one of a passenger, with respect to the glazing unit is not known in an exceptional situation, for example a derailment of the cable.

In another embodiment variant, the connection element of the cabin consists of a bendable and/or flexible cable section. One of the advantages of the invention is that a cable consisting of a plurality of wires and strands has the necessary elastic properties to withstand the potential loads. The cable section is preferably made from a steel cable. The steel cable is virtually indestructible by willful manipulation.

In one embodiment variant, a sleeve is connected to at least one end of the cable section. One of the advantages of the invention is that the mechanical connectivity of the cable section to the cabin and/or the glazing unit is made easier. This embodiment allows a secure mechanical connection of the end section of the connection element to the cabin and/or glazing unit. With respect to a loop formed by means of the cable section, the proposed sleeve allows are more compact construction. The connection between cable section and sleeve can be generated by compressing, welding or in a different manner.

In another embodiment variant, the first fastening element of the cabin has at least one first and one second fastening part which both clamp the glazing unit and the first and the second fastening part are connected to each other by holding means. One of the advantages of the invention is that by means of the fastening parts, a preferably permanent fastening of the connection member of the cabin to the glazing unit is ensured. As holding means serve, for example, screws which can be protected against manipulations. The detachable connection allows that the glazing unit can be replaced by qualified personnel at any time.

In one embodiment variant, the glazing unit is connected to the cabin by means of a plurality of connection members. One of the advantages of the invention is that, for example, depending of the area of the glazing unit, two, three, four or more connection members are used for securing the glazing unit. The connection members, for example, can be fastened crosswise in the region of the corners of the glazing unit. Depending on the configuration of the glazing unit, further arrangements of the connection members are also possible.

In a further embodiment variant, the holder of the cabin comprises a plurality of individual holders by means of which the glazing unit can be connected to the cabin. In another embodiment variant, the holder comprises a frame holder encompassing the glazing unit, by means of which frame holder, the glazing unit can be connected to the cabin. In a further embodiment variant, the glazing unit can be connected to the frame holder in an at least partially jointless manner. One of the advantages of the invention is that the connection members for securing the glazing unit can be connected to the cabin and the glazing unit regardless of how the holder of the glazing unit is designed.

In one embodiment variant, the second fastening element can be connected to the frame holder of the cabin by means of holding means. One of the advantages of the invention is that the second fastening element of the connection member can be retroactively fastened to already existing cabins. A secure fastening of the glazing unit by means of the first and second fastening elements as well as the connection element is therefore possible for different types and designs of cabins. As holding means, screws, bolts, rivets etc. can be used. A welded connection can also serve as holding means. The second connection element can be an integral part of the cabin.

In another embodiment variant, the one end of the connection element is an integral part of the cabin and is connected thereto in a non-detachable manner. One of the advantages of the invention is that the connection element is directly connected to the cabin, for example in that the connection element is screwed, welded, compressed, riveted to the cabin or connected with pins thereto. A screw connection can be secured in a known manner so that a non-detachable connection exists. The connection element can be connected to the cabin, for example, by providing the one sleeve or socket of the cable section with a thread.

In a further embodiment variant, the fastening element has a recess for receiving the one sleeve of the cable section, wherein the cable section can be guided through an edge recess and/or hole. One of the advantages of the invention is that due to this embodiment, the fastening element can be mounted on flat as well as on curved or uneven surfaces. The recess ensures here that after mounting the fastening element, the cable section is permanently secured on the provided surface.

In one embodiment variant, the first fastening part is formed with a recess for receiving the one sleeve of the cable section and an edge recess for receiving the cable section. One of the advantages of the invention is that the installation height of the fastening part depends substantially on the diameter of the sleeve and thereby, a flat construction of the fastening part is possible. In a further embodiment variant, the length of the recess is greater than the length of the sleeve. This has the advantage that the thermal expansion of the glazing unit and/or the cabin can be compensated by allowing the sleeve to be movable along its length within the recess. Thermal expansion is to be understood as the change of the geometrical dimensions (length, area, volume) of a body caused by a change of its temperature.

In another embodiment variant, the fastening parts are made of light metal and are provided at least partially with an elastic layer on the surface facing the glazing unit. One of the advantages is that the fastening parts are made of stainless light metal, preferably aluminum, so that the payload of the cabin is only insignificantly affected. As elastic layer, plastic and/or rubber is used. Said layer serves, on the one hand, for sealing the holes in the glazing unit. A further advantage of the elastic layer is that load is taken off the holding means and that the force acting on the first fastening element is distributed via the elastic layer over the contact surface between glazing unit and fastening element.

The invention is explained in more detail hereinafter by means of the exemplary embodiments illustrated in the drawings. In this connection, further essential features and advantages of the invention arise from the drawings and the description thereof.

Figure 1:
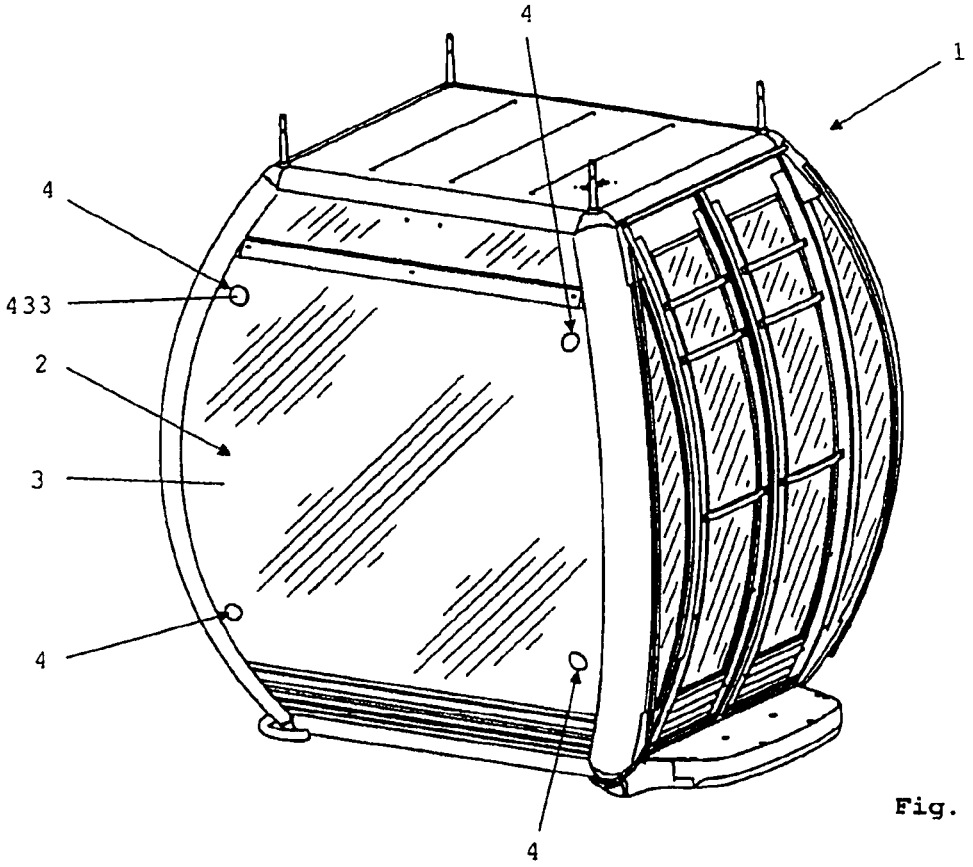
FIG. 1 shows a schematic, perspective interior view of the cabin according to the invention with a glazing unit which is secured to the cabin by four connection members.

FIG. 1 illustrates a cabin according to the invention designated with the reference number 1. The cabin 1 illustrated from the outside is used in particular for cable cars, cable railways and/or gondola lifts. The cabin 1 can also be used for funiculars, roller coasters or Ferris wheels. The cabin has an opening 2. In said opening 2, a glazing unit 3 is secured. FIG. 1 shows four connection members 4 which each are connected with the glazing unit 3 and the cabin 1. The four fastening parts 433 of the connection members 4 on the outside of the cabin 1 are shown in this view. The further components of the connection members 4 on the inside of the cabin 1 are not illustrated here. Moreover, the cabin 1 has different, smaller openings with glazing units secured therein. For the glazing unit 3, preferably, polycarbonate is used, for example as transparent windowpane or plate. Usually, the glazing unit is flat, slightly curved or spherically bent. Other materials can also be used, provided there is no other reason not to use it.

Figure 2:
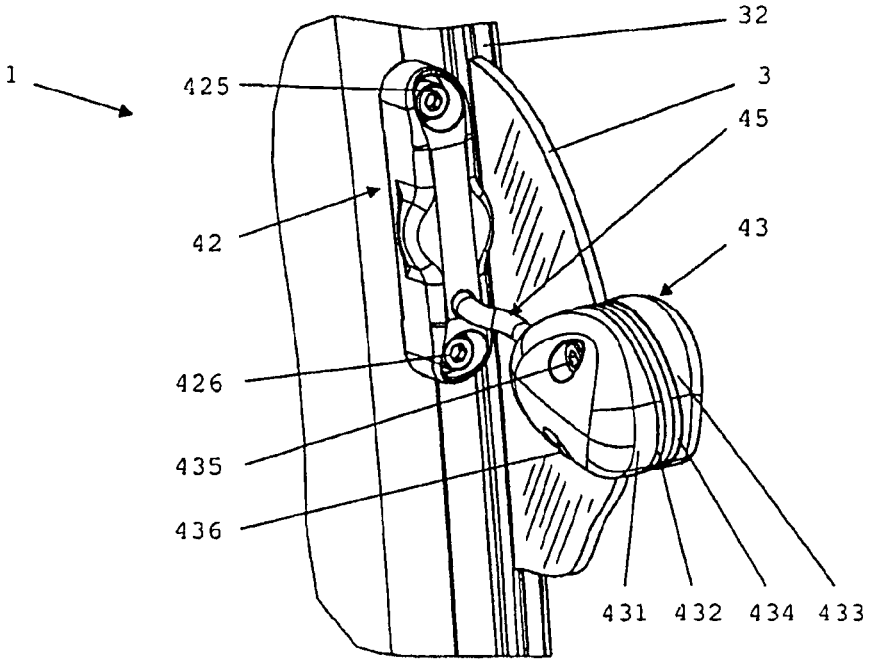
FIG. 2 shows a schematic, perspective view of the connection member, wherein one fastening element is mounted on the glazing unit and a further fastening element is mounted on the cabin and both are connected to each other by a connection element.

FIG. 2 shows an interior view of the cabin 1 and illustrates in detail a connection member designated with the reference number 4. The connection member 4 comprises a first fastening element 43, a second fastening element 42 and a connection element 45 connecting the fastening elements to each other. The first fastening element 43 comprises two fastening parts 431, 433. One fastening part is attached on the inside of the cabin 1 on the glazing unit 3 and a further fastening part is attached on the outside of the cabin 1 on the glazing unit 3 and both are connected to each other by holding means 435, 436. As holding means, preferably screws and nuts are used, wherein the nuts can be part of the one fastening part. However, other holding means can also be used. Instead of screws, long pins can be used which each are compressed at their ends so that the connection is non-detachable. Between the glazing unit and each of the fastening parts 431, 433, preferably, an elastic layer 432, 434 is arranged. Said layer has the purpose that a fastening part 431, 433 does not rub directly against the glazing unit 3. Friction would result in abrasion of material on the glazing unit 3 which could have a negative effect on the connection between the fastening parts 431, 433. Each pair of the two fastening parts 431, 433 of a fastening element 43 clamps the glazing unit 3 by means of a screw connection. The pressing force generated in this manner causes an increased friction in the elastic layer on both sides of the glazing unit 3. If an exceptional situation occurs, for example a derailing of the cable, the resulting load is distributed at the respective fastening elements 43 over the contact surface of the fastening parts 431, 433 and over the holding means 435, 436 or 437, 438. The elastic layer is preferably made of rubber or an elastic, stretchable plastic. The fastening part 431 attached to the inner side of the glazing unit 3 can also be completely covered with an elastic layer. The fastening element 43 can also consist of a single fastening part to which the connection element 45 is connected. Here, a U-shaped rod can be used as holding means 435, 436, which rod is inserted on the outside of the glazing unit 3 through holes in the glazing unit 3 provided for this purpose and through the fastening part 431 attached on the inside of the glazing unit 3. The ends of the U-shaped rod can be secured, for example with pins, by compressing or by means of a thread-nut connection. The holder of the glazing unit 3 is designated with the reference number 32. In FIG. 2, a glazing unit 3 is illustrated which is secured in a gap or groove by means of a rubber strip. The glazing unit 3 rests jointless in the holder 32. The glazing unit 3 is shown as cut-out in FIG. 2. The fastening element 42 is fastened with holding means 425, 426 to the inside of the cabin 1. The connection element 45 connects the first and the second fastening elements 43 and 42, respectively.

Figure 3:
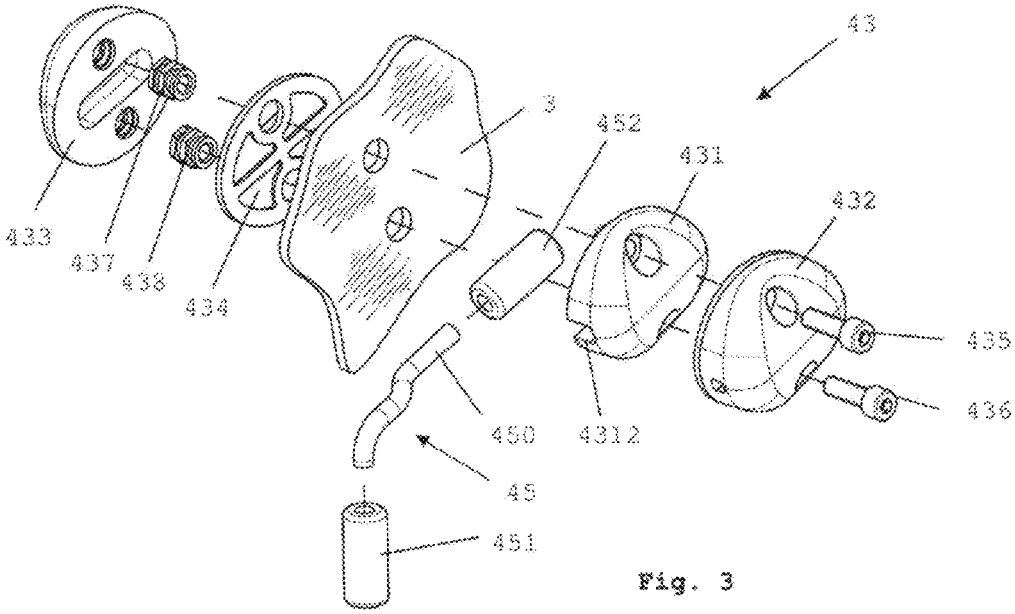
FIG. 3 shows a detail of FIG. 2 in an exploded view.

FIG. 3 illustrates the fastening element 43 and the connection element 45 in an exploded illustration. The glazing unit, here illustrated as cut-out, has the reference number 3. Illustrated is the glazing unit 3 on the inside of the cabin 1. Two holes are provided, through which the holding means 435, 436 can be inserted. An elastic layer 434, for example designed as disk or membrane and preferably made of rubber is retained between the glazing unit 3 and the fastening part 433. The fastening part 433 preferably has two holding means 437, 438. The latter are usually implemented as threaded bushes with an internal thread and are connected to the fastening part 433 in a non-detachable manner. On the inside of the cabin 1 too, an elastic layer is placed onto the glazing unit 3. In FIG. 3, said layer is designated with the reference number 432. The elastic layer is preferably made of rubber. However, other materials can also be used. The fastening part 431 can be completely or partially enclosed by said elastic layer. However, such an elastic layer is provided at least on the surface facing the glazing unit 3. Between the glazing unit 3 on the inside of the cabin 1 and the fastening part 431, the one sleeve 452 of the connection element 45 configured as cable section 450 is secured. The cable section 450 is guided through an edge recess 4312 of the fastening part 431.

Figure 4:
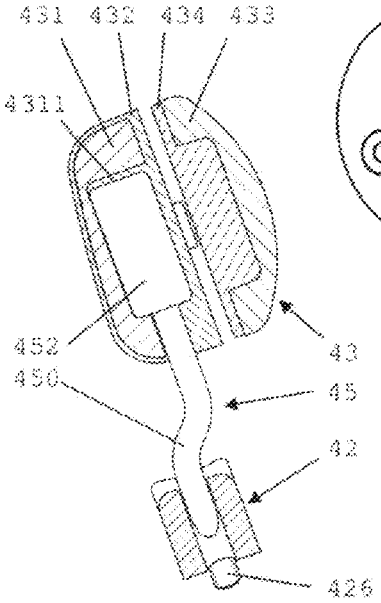
FIG. 4 shows a section of the connection member along the line IV-IV of FIG. 5.

FIG. 4 shows a sectional view of the connection member 4 with a first fastening element 43, a second fastening element 42 and a connection element 45. The connection element is usually flexible and/or bendable. It is preferably made from a cable section 450. At least on one end of the cable section 450, a sleeve 451, 452 is connected. The connection can also be generated by compression. Thereby, the connection between sleeve and cable section is permanent. The one sleeve of the connection element 45 is secured in the recess designated with 4311 in the fastening means 431. Here, the cable section 450 is guided through an edge recess 4312. The other end of the connection element 45 is retained by the second fastening element 42.

Figure 5:
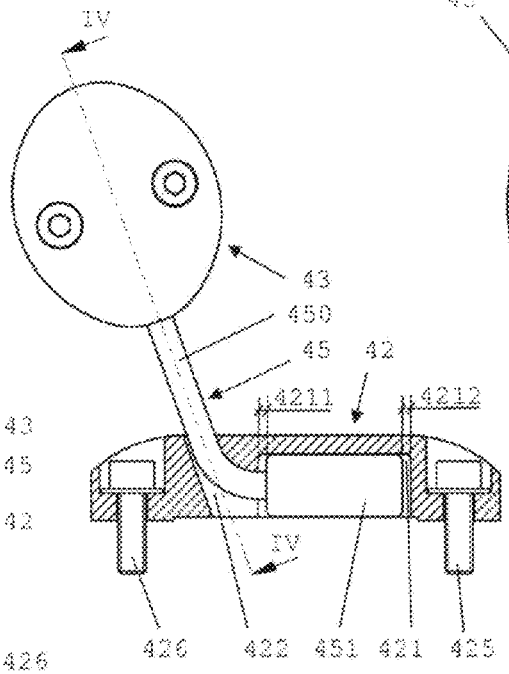
FIG. 5 shows a section of the connection member along the line V-V of FIG. 6.

FIG. 5 illustrates the connection member 4 in a side view and shows a section of the fastening element 42. Section IV-IV is illustrated in FIG. 4. The second fastening element 42 has a recess 421 for receiving the sleeve 451 of the connection element 45. The cable section 450 is guided through a hole or an opening 422 in the fastening element 42 so that the second end of the cable section 450, which is not illustrated in FIG. 4, can be secured in the first fastening element 43. The holding means 425, 426 are used for connecting the fastening element 42 to the cabin 1. As holding means, preferably, screws are used. The recess 421 is formed in such a manner that its length L is greater than the length of the sleeve 451. Thereby, mechanical tolerances of the cabin 1 and/or the glazing unit 3 can be compensated. Changes of the dimensions of the glazing unit 3 and/or the cabin 1 which, for example, occur due to the influence of temperature fluctuations can also be compensated. This compensation is made possible by a gap or clearance 4211, 4212 generated between the front sides of the sleeve 451 received in the recess so that the sleeve is freely movable within certain limits in the longitudinal direction.

Figure 6:
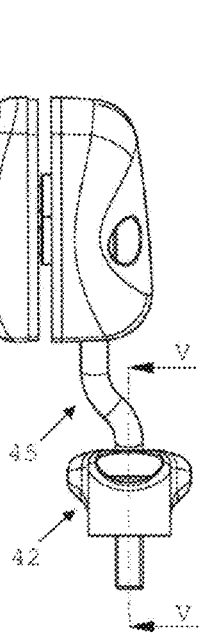
FIG. 6 shows a further view of the connection member.
Figure 7:
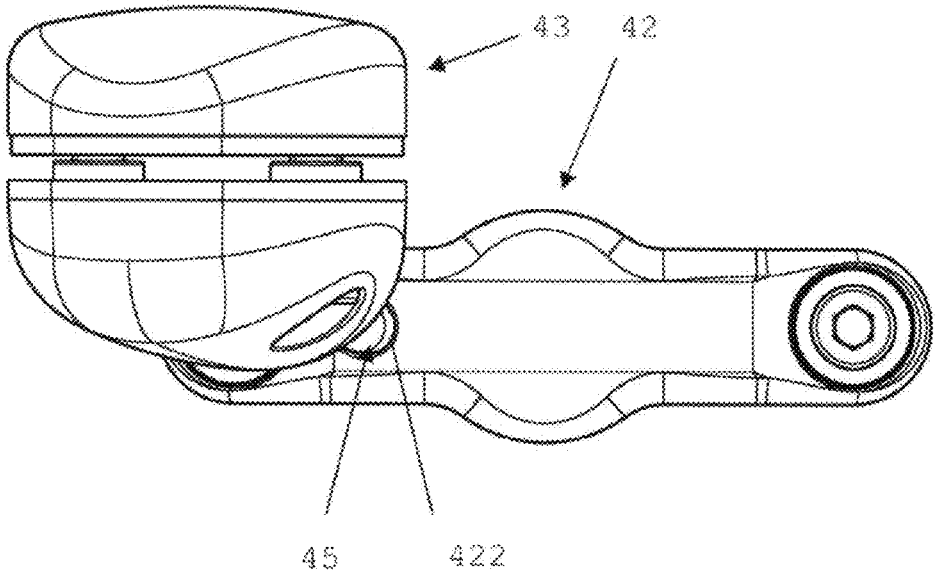
FIG. 7 shows a top view of the connection member.
Figure 8:
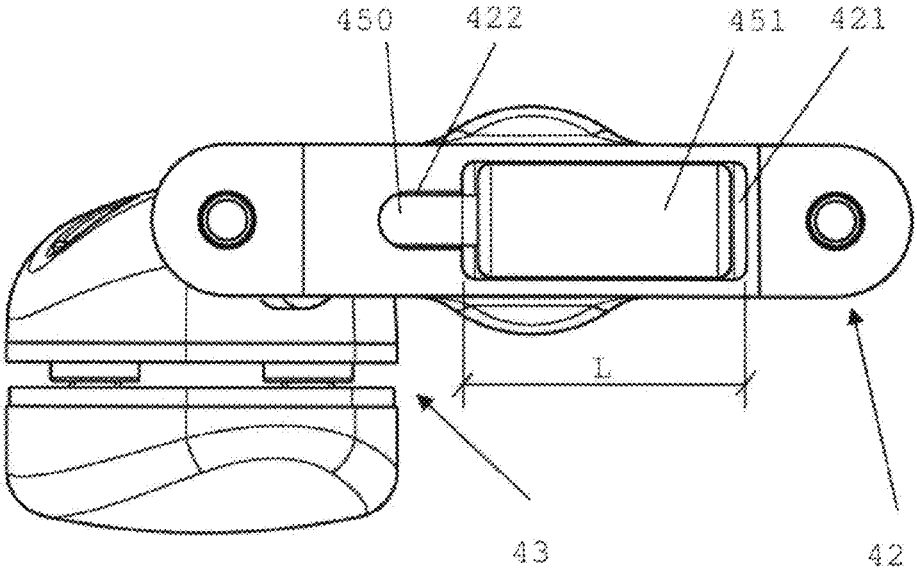
FIG. 8 shows another view of the connection member.

The FIGS. 6, 7 and 8 illustrate further views of the connection member 4 with a first fastening element 43, a second fastening element 42 and a connection element 45. The section line V-V in FIG. 6 is illustrated as section in FIG. 5.

Figure 9:
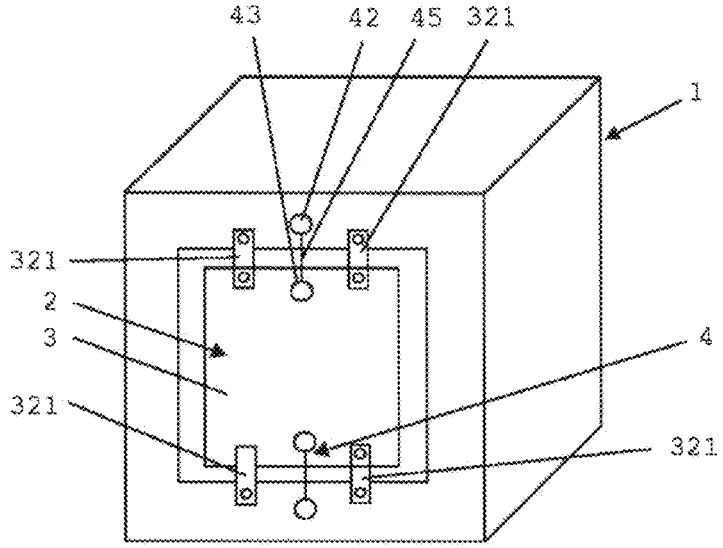
FIG. 9 shows a cabin with a glazing unit that is retained by individual holders in an opening of the cabin, wherein the area of the glazing unit is smaller than the one of the opening and wherein two connection members secure the glazing unit on the cabin.

FIG. 9 shows an embodiment of the cabin 1 with an opening 2 and a glazing unit 3 which is secured in the opening 2 by individual holders 321 attached to the cabin 1 and to the glazing unit 3. FIG. 9 illustrates two connection members 4 each with a first and a second fastening element 43,42 and a connection element 45. Each connection member 4 is connected to the cabin 1 and the glazing unit 3. The area of the glazing unit 3 is smaller than the area of the opening 2.

Figure 10:
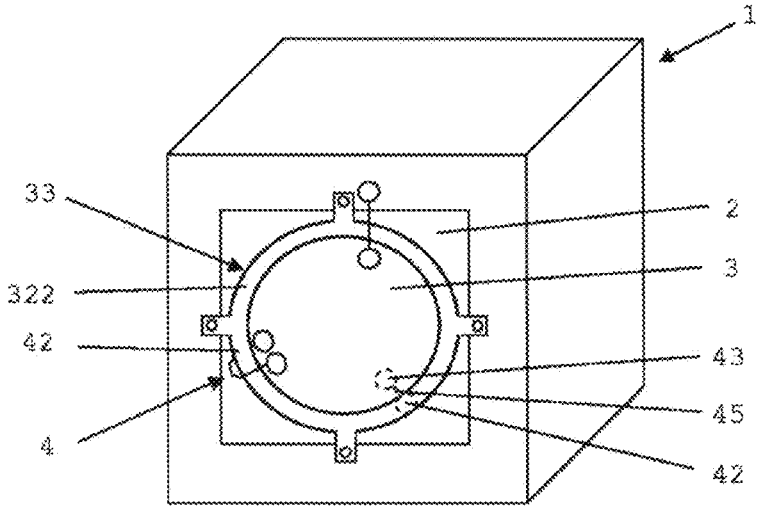
FIG. 10 shows a cabin with a glazing unit that is retained in an opening of the cabin by a frame holder, wherein three connection members secure the glazing unit on the cabin.

FIG. 10 illustrates a further embodiment of the cabin 1 with a glazing unit 3 which is secured in the opening 2 by a frame holder 322. The fastening element 42 of the connection member 4 can be fastened to the frame holder 322 and/or to the cabin 1 and/or to the glazing unit 3. In the latter case, the connection element 45 is looped around the frame holder and fastened to the fastening element 43. This shows that the fastening elements 42, 43 can be fastened in the interior region as well as in the exterior region of the cabin 1.

Figure 11:
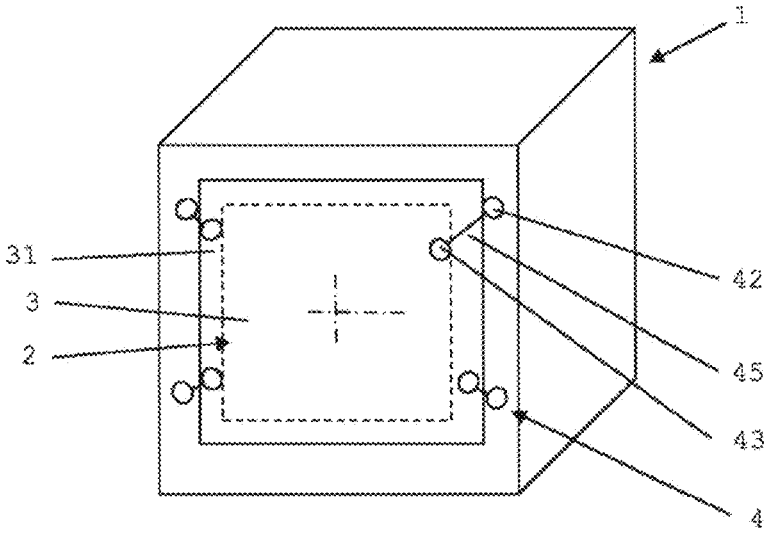
FIG. 11 shows a cabin with an opening, wherein a glazing unit is mounted in front of said opening, wherein four connection members secure the glazing unit on the cabin.
Figure 12:
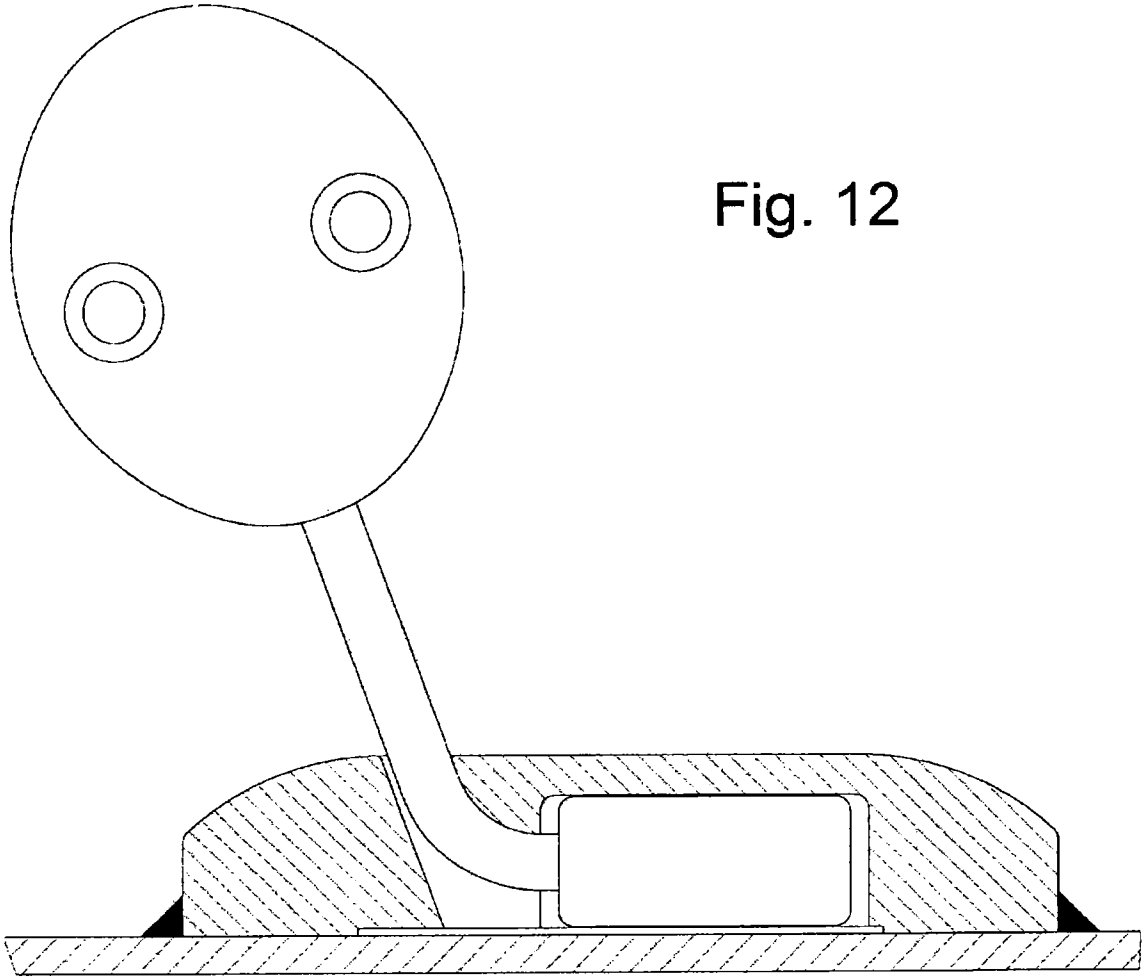
FIG. 12 shows a non-limiting illustrative example of a welded connection as holding means.
Figure 13:
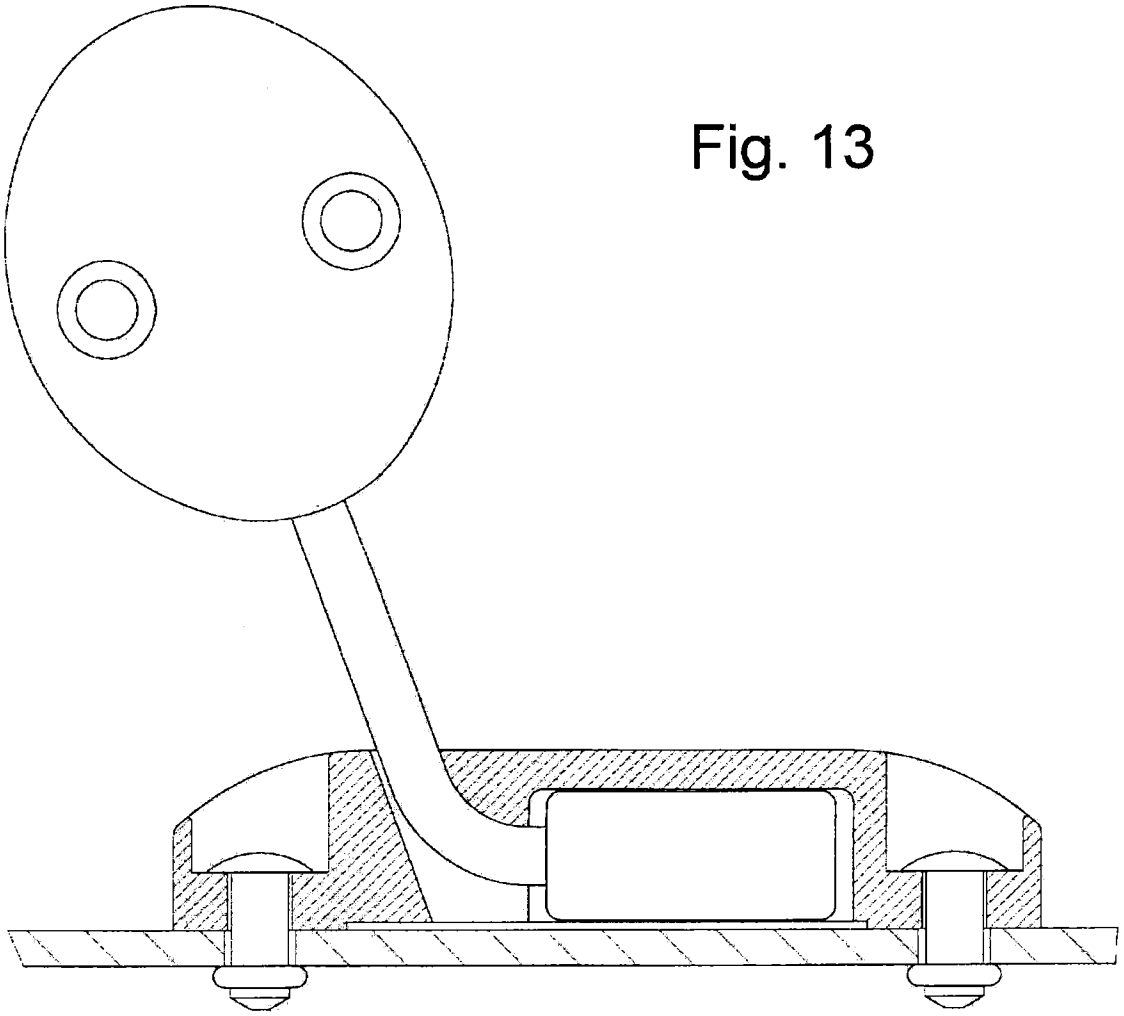
FIG. 13 shows a non-limiting illustrative example of rivets as holding means.
Figure 14:
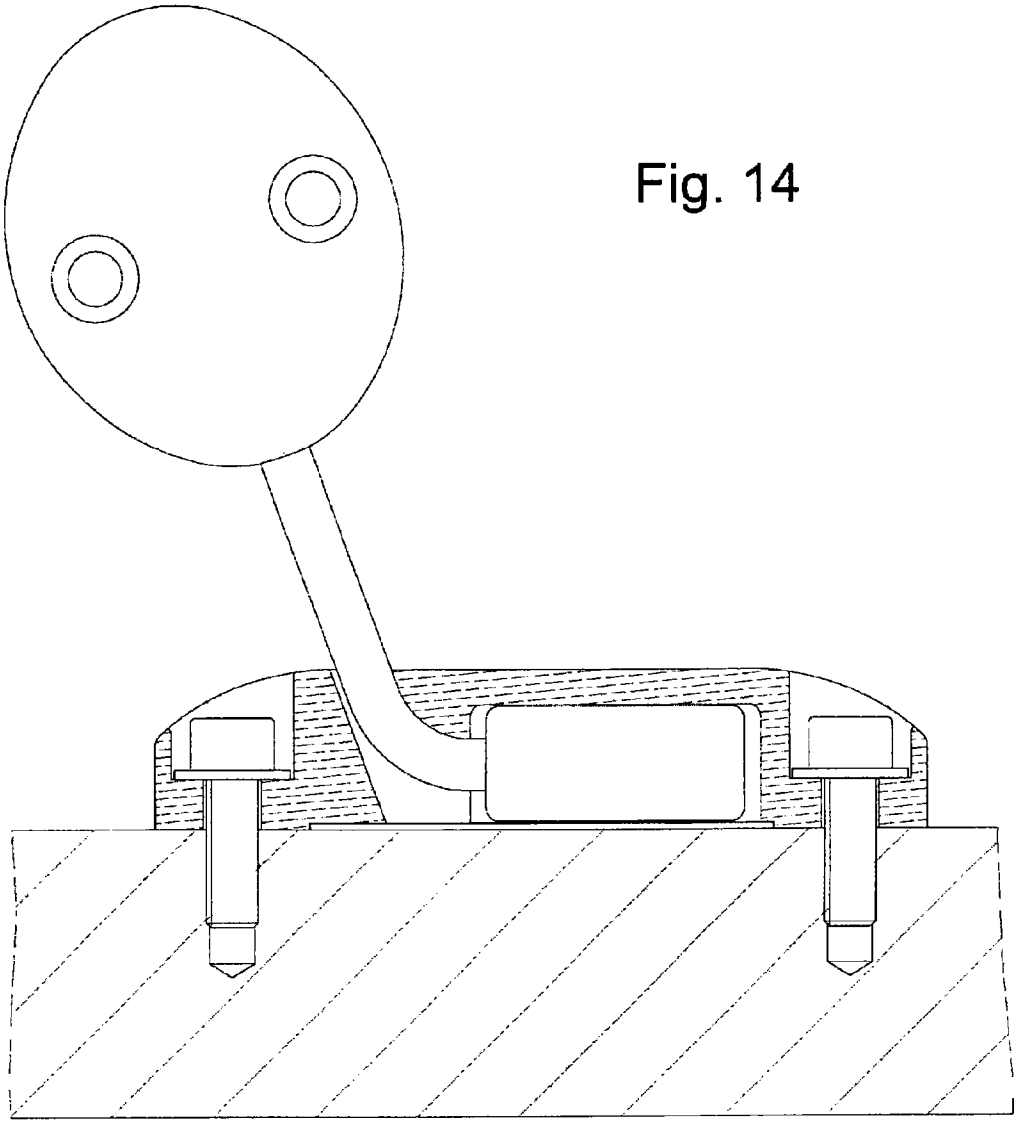
FIG. 14 shows a non-limiting illustrative example of screws as holding means.
Figure 15:
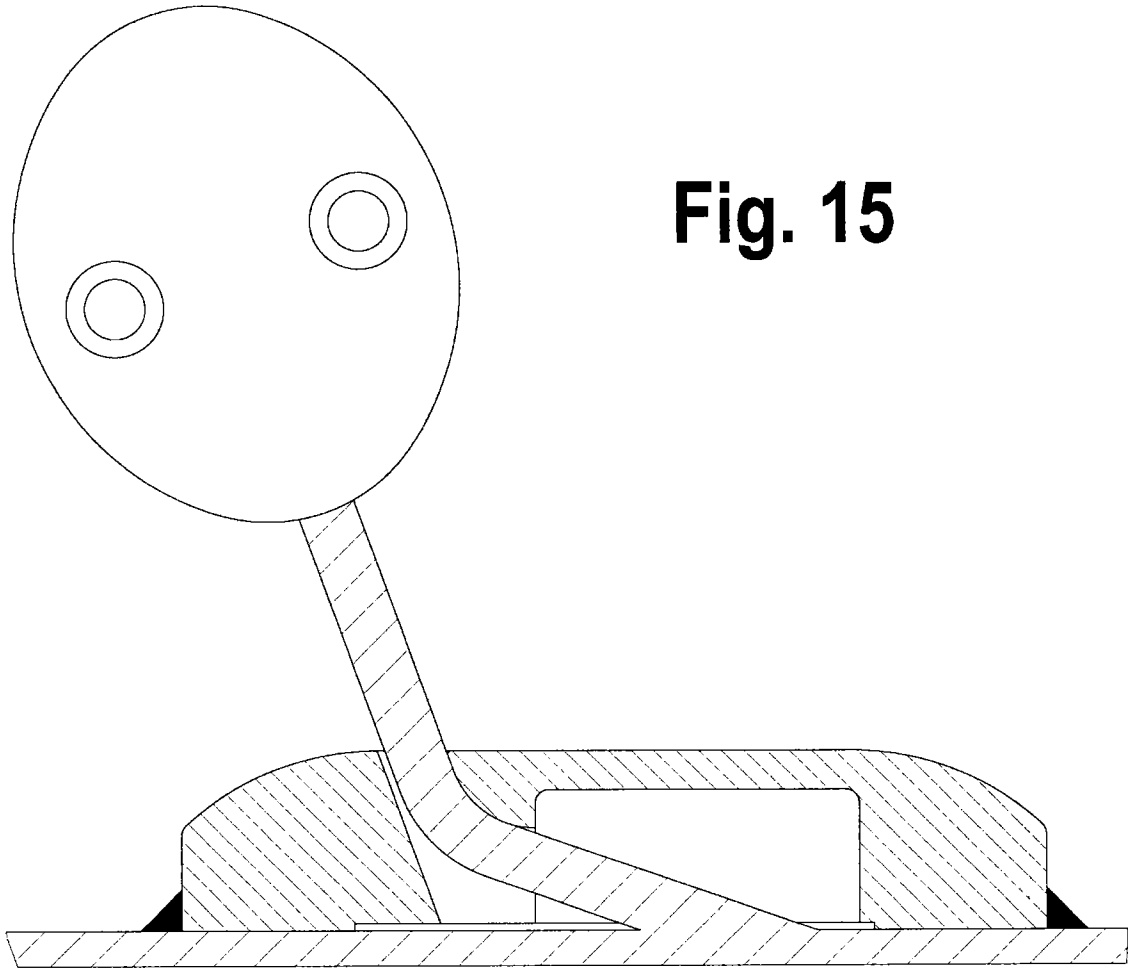
FIG. 15 shows a non-limiting illustrative example of the connection element being an integral part of the cabin.
Figure 16:
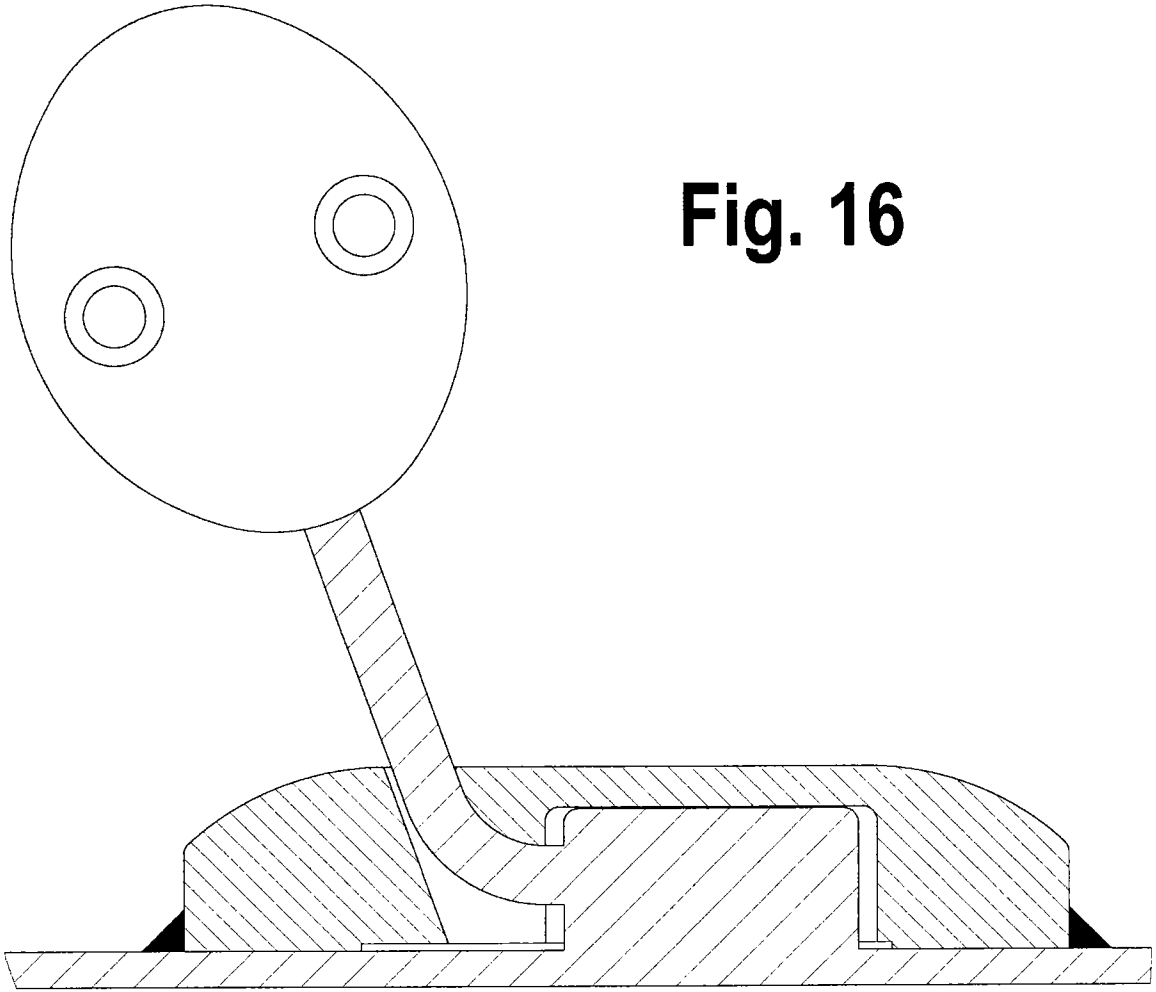
FIG. 16 shows another non-limiting illustrative example of the connection element being an integral part of the cabin.
Figure 17:
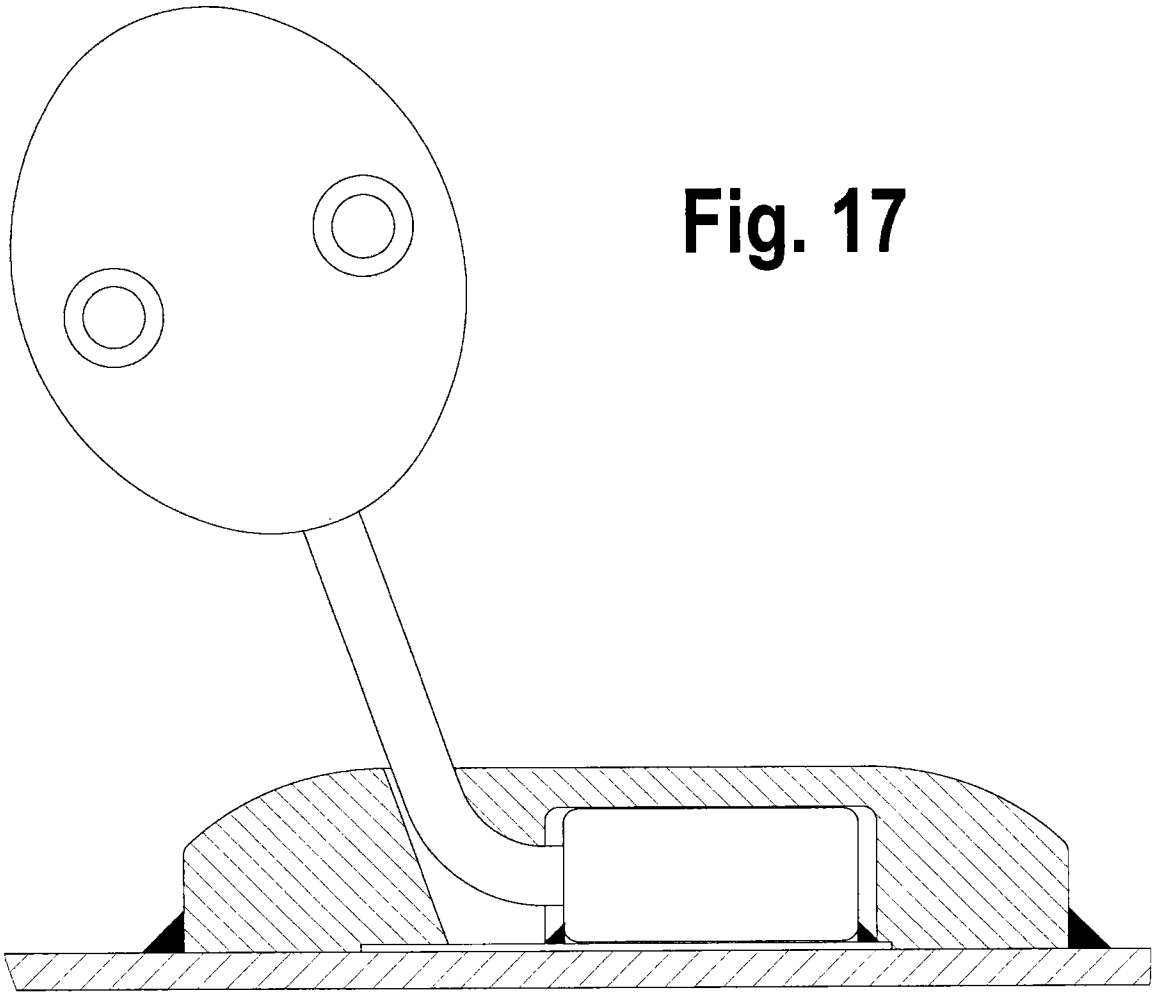
FIG. 17 shows another non-limiting illustrative example of a welded connection as holding means.

FIG. 11 illustrates schematically a cabin 1 with an opening 2, wherein the glazing unit 3 covers the opening. The glazing unit 3, for example, can be glued to the cabin 1. In FIG. 11, four connection members 4 are shown. The center of the glazing unit 3 is schematically illustrated with a reticle. Here, the connection members 4 are mounted in such a manner that the respective fastening elements lie on a line with the center.

REFERENCE NUMBER LIST

1 Cabin
2 Opening
3 Glazing unit
32 Holder
321 Individual holders
322 Frame holder
4 Connection member
42 Fastening element
421 Recess
4211 Clearance/gap
4212 Clearance/gap
422 Hole
425 Holding means
426 Holding means
43 Fastening element
431 Fastening part
4311 Recess
4312 Edge recess
432 Membrane
433 Fastening part
434 Membrane
435 Holding means
437 Holding means
438 Holding means
426 Holding means
45 Connection element
450 Steel cable section
451 Sleeve/socket
452 Sleeve/socket
L Length

The invention claimed is:

1. A cabin for cable cars for accommodating at least one of passengers and goods, comprising:

an opening;

a holder fastened to the cabin to hold a glazing unit in the opening, the holder holding opposing sides of the glazing unit;

at least two connection members that each comprise a first fastening element connected to the glazing unit and a second fastening element connected to the cabin;

wherein the first fastening element and second fastening element are connected to each other by a connection element, and wherein the glazing unit is secured in a region of the opening by the at least two connection members when the glazing unit detaches itself from the holder.

2. The cabin according to claim 1, wherein the connection element is formed in at least one of a bendable manner and a flexible manner.

3. The cabin according to claim 2, wherein the connection element includes a cable section that is at least one of bendable and flexible.

4. The cabin according to claim 3, wherein at least on one end of the cable section, a sleeve is connected.

5. The cabin according to claim 4, wherein at least one of the first and second fastening elements includes a recess to receive the one sleeve of the cable section, wherein the cable section is guidable through at least one of an edge recess and a hole.

6. The cabin according to claim 1, wherein the first fastening element includes at least one first and one second fastening part that clamp the glazing unit.

7. The cabin according to claim 6, wherein the first and the second fastening parts are connected to each other by a holding means.

8. The cabin according to claim 6, wherein the first fastening part is formed with a recess to receive one sleeve of a cable section and with an edge recess to receive the cable section.

9. The cabin according to claim 8, wherein a length of the recess is greater than a length of the sleeve.

10. The cabin according to claim 7, wherein the fastening parts are made of light metal and are provided at least partially with an elastic layer on the surface facing the glazing unit.

11. The cabin according to claim 1, wherein the glazing unit is connected to the cabin by a plurality of the connection members.

12. The cabin according to claim 1, wherein the holder comprises a plurality of individual holders by which the glazing unit is connectable to the cabin.

13. The cabin according to claim 1, wherein the holder comprises a frame holder encompassing the glazing unit, by which frame holder, the glazing unit is connectable to the cabin.

14. The cabin according to claim 13, wherein the glazing unit of the cabin is configured to be jointlessly connected to at least a part of the frame holder.

15. The cabin according to claim 13, wherein the second fastening element is configured to be connected to the frame holder of the cabin by a holding means.

16. The cabin according to claim 1, wherein one end of the connection element is an integral part of the cabin.

17. A cabin for cable cars for accommodating at least one of passengers and goods, comprising:

an opening;

a holder fastened to the cabin to hold a glazing unit in the opening;

at least two connection members that each comprise a first fastening element connected to the glazing unit and a second fastening element connected to the cabin;

wherein the first fastening element and second fastening element are connected to each other by a connection element, and the connection element includes a cable section, and wherein the glazing unit is secured in a region of the opening by the at least two connection members when the glazing unit detaches itself from the holder.

* * * * *